United States Patent [19]

Iwasawa et al.

[11] Patent Number: 4,476,428

[45] Date of Patent: Oct. 9, 1984

[54] POWER SUPPLY DEVICE

[75] Inventors: Teruo Iwasawa; Hitomi Tojiki, both of Tokyo, Japan

[73] Assignee: Olympus Optical Co., Ltd., Tokyo, Japan

[21] Appl. No.: 505,117

[22] Filed: Jun. 20, 1983

Related U.S. Application Data

[63] Continuation of Ser. No. 404,379, Aug. 2, 1982, abandoned, which is a continuation of Ser. No. 273,427, Jun. 15, 1981, abandoned.

[30] Foreign Application Priority Data

Jun. 16, 1980 [JP] Japan ..... 55-83811[U]

[51] Int. Cl.[3] ..... G05F 3/20

[52] U.S. Cl. ..... 323/314; 323/316; 323/901

[58] Field of Search ..... 323/280, 281, 349, 313–316, 323/901; 307/296 R, 297; 330/257, 288, 296, 297

[56] References Cited

U.S. PATENT DOCUMENTS

| | | | |
|---|---|---|---|
| 3,671,770 | 6/1972 | Frederiksen | 323/281 X |
| 3,787,757 | 1/1974 | Sheng | 323/901 X |
| 3,943,380 | 3/1976 | Morgan et al. | 323/315 X |
| 3,984,761 | 10/1976 | Edington et al. | 323/901 X |
| 4,029,974 | 6/1977 | Brokaw | 323/315 X |
| 4,051,392 | 9/1977 | Rosenthal et al. | 323/901 X |

*Primary Examiner*—Peter S. Wong

*Attorney, Agent, or Firm*—Toren, McGeady and Stanger

[57] ABSTRACT

A power supply device for use in a superminiature tape recorder is disclosed. The device comprises a reference voltage generator circuit for generating an output therefrom in response to a reference voltage, a constant-current circuit for generating a constant current to obtain the reference voltage, a starting circuit for supplying a starting current to the constant current circuit and for branching a part of the starting current, and an electronic switch for causing flow of starting current therein so as to turn the constant-current circuit OFF.

3 Claims, 2 Drawing Figures

POWER SUPPLY DEVICE

This application is a continuation of application Ser. No. 404,379, filed Aug. 2, 1982 abandoned. which in turn is a continuation of Ser. No. 273,427, filed June 15, 1981, abandoned.

BACKGROUND OF THE INVENTION

The present invention relates to a power supply device with an electronic switch particularly for use with a tape recorder.

Recently, tape recorders have been subminiaturized, the power supplies therefor also tend to be miniaturized as integrated circuits, and switches in the devices also become electronic switches instead of mechanical switches which occupy large spaces.

If a switch which is mechanically turned ON or OFF is used, however, a power supply source can completely be cut off at the time of OFF switching condition and electric power to be consumed can completely cut to zero. However if an electronic switch is used, it is difficult entirely to cut the power consumed to zero in the OFF switching condition. As often seen in subminiature tape recorders, if a battery having small capacity is used, it is impossible to ignore the problem that the lifetime of the battery is short.

FIG. 1 shows an embodiment of a conventional power supply device. In FIG. 1, a transistor $Q_4$ is connected as a diode, and forms a current mirror circuit together with a transistor $Q_5$ to obtain a reference voltage. Moreover, in order to keep the reference voltage unchanged even during fluctuation of the power supply voltage, there is provided a constant-current circuit composed of transistors $Q_2$, $Q_3$ and resistors $R_1$, $R_2$, $R_3$. This supply device also includes a differential amplifier circuit composed of transistors $Q_{10}$, $Q_{11}$, $Q_8$ and $Q_9$, and a current-mirror circuit composed of transistors $Q_6$, $Q_7$ and resistances $R_4$, $R_5$. The transistors $Q_{10}$ and $Q_{11}$ are active loads of the transistors $Q_8$ and $Q_9$. Moreover, reference $Q_{13}$ is a control transistor for supplying current to a load $R_L$, and reference $Q_{12}$ is a transistor for driving a control transistor $Q_{13}$. The resistors $R_7$ and $R_8$ are feedback resistors for determining the output voltage $V_{out}$ supplied to the load $R_1$, which output voltage $V_{out}$ is $(1+R_7/R_8)$ times the reference voltage. Reference $Q_1$ is an MOS FET of N channel type for forming an electronic switch and has an opened drain of CMOS IC as an output in the inside thereof. This electronic switch $Q_1$ turns the whole power supply device ON and OFF by biasing the transistor $Q_3$ ON or OFF. That is, when the electronic switch $Q_1$ is ON, the transistor $Q_3$ is cut off and the transistor $Q_2$ is also cut off, and then transistors $Q_4$, $Q_5$, $Q_6$, $Q_7$ and the transistors $Q_8$, $Q_9$, $Q_{10}$, $Q_{11}$, $Q_{12}$, $Q_{13}$ are cut off, and then all the transistors are cut off. But, the switch $Q_1$ has a very small potential difference between drain and source thereof while ON, so that the switch $Q_1$ has a current of $V_{EE}/R_1$ at maximum flowing therein. It means that if $V_{ee}=3V$, $R_1=30$ $k\Omega$, the whole power supply device cannot be turned OFF as a current of about 100 $\mu$A flows into the N channel MOS FET. When such electronic switch is used, fairly large power is consumed even in the OFF condition, so that there is a drawback that the lifetime of the battery is shortened. Besides, since a current of 100 $\mu$A flows into FET as the switch $Q_1$, a large FET having large capacity must be used, which is not desirable for minimizing a switch.

SUMMARY OF THE INVENTION

An object of the present invention is to eliminate the above described disadvantages of the conventional power supply device.

Another object of the present invention is to provide a power supply device with the use of an electronic switch which can mitigate by a large margin the electric power to be consumed in the OFF condition.

According to the present invention there is provided a power supply device comprising a reference voltage generator circuit for generating an output therefrom in response to a reference voltage, a constant-current circuit for generating a constant current to obtain the reference voltage, a starting circuit for supplying a starting current to the constant-current circuit and for branching a part of the starting current, and an electronic switch for flowing the starting current therein so as to make the constant-current circuit OFF condition. The electronic switch is AMOS FET.

DESCRIPTION OF THE PREFERRED EMBODIMENT

Figure 1:
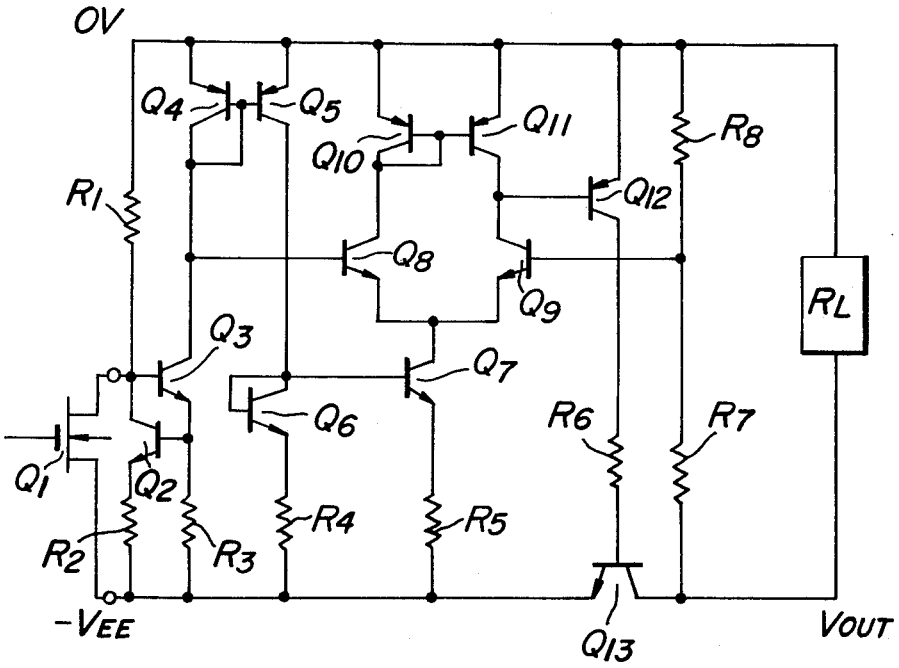
FIG. 1 PRIOR ART
FIG. 1 is circuit diagram showing a construction of one embodiment of the conventional power supply device.
Figure 2:
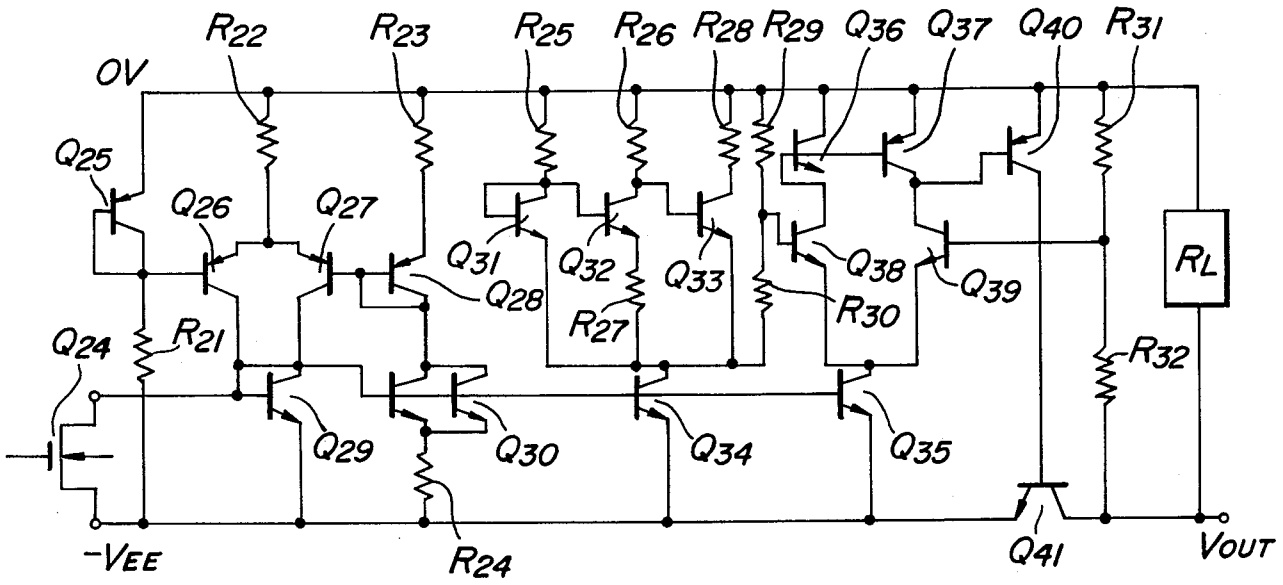
FIG. 2 is a circuit diagram showing a construction of one embodiment of a power supply device according to the present invention.

FIG. 2 shows an embodiment of a power supply device according to the present invention. In FIG. 2, transistors $Q_{31}$, $Q_{32}$, $Q_{33}$ resistors $R_{25}$, $R_{26}$, $R_{27}$, $R_{28}$ form a reference voltage generator circuit having high efficiency. This circuit is a famous band gap reference voltage source. Resistors $R_{29}$ and $R_{30}$, compose a series resistor circuit for dividing a reference voltage. Moreover, transistors $Q_{38}$, $Q_{39}$ are amplifier transistors and form a differential amplifier circuit. Transistors $Q_{36}$, $Q_{37}$ are active loads of the above amplifier circuit. Moreover, a transistor $Q_{41}$ is a control transistor for supplying a current to a load $R_L$, a transistor $Q_{40}$ is a driving transistor for driving the control transistor $Q_{41}$, and resistors $R_{31}$, $R_{32}$ are feedback resistors for determining an output voltage supplied to the load $R_L$.

Transistors $Q_{29}$, $Q_{34}$, $Q_{35}$, are pair transistors and a transistor $Q_{30}$ has an emitter area which is twice the above transistors $Q_{29}$, $Q_{34}$, $Q_{35}$. These transistors $Q_{29}$, $Q_{30}$, $Q_{34}$, $Q_{35}$, form a current mirror circuit and form a constant current source. The transistors $Q_{29}$ and $Q_{30}$ establish a constant-current circuit for generating a constant current to obtain a reference voltage together with transistors $Q_{27}$ and $Q_{28}$ and resistors $R_{22}$, $R_{23}$ and $R_{24}$. In this case, a current value of the circuit is $V_T 1_n{}^2/R_{24}$. (Here, $V_T=k_T/g$, q is the charge of an electron, k is the Bolzamann constant and T is the absolute temperature.) It is a matter of course that this current value is determind by $V_T 1_n n/R_{24}$ when the emitter area of the transistor $Q_{30}$ becomes n.

The transistors $Q_{27}$ and $Q_{30}$ each have a collector connected to the base of the other and further formed by thyristor connection. Moreover, the transistor $Q_{28}$ does not serve as a gate and the transistor $Q_{29}$ serves as a gate. Therefore, when a current is supplied to the base of the transistor $Q_{29}$ from the outside, the thyristor consisting of the transistor $Q_{27}$ and $Q_{30}$ turns ON and each emitter of the transistors $Q_{29}$ and $Q_{39}$ flows a current thereto by the positive feedback operation.

Transistors $Q_{25}$ and $Q_{26}$ and resistors $R_{21}$ and $R_{22}$ form a starting circuit. In this case the transistor $Q_{25}$ is always biased so that the transistor $Q_{26}$ produces an extremely small collector current flowing through the resistor $R_{22}$ thereby to supply a bias current to the transistors $Q_{27}$, $Q_{28}$, $Q_{29}$ and $Q_{30}$. In this case, the resistor $R_{24}$ is set to make an emitter current of the transistor $Q_{29}$ 100 $\mu$A for example and the resistor $R_{22}$ about 5 k$\Omega$ thereby to produce a voltage drop about 0.5 V here. Then, the transistor $Q_{29}$ goes ON so that the transistor $Q_{26}$ is completely cut off, thereby preventing the constant-current circuit consisting of the transistors $Q_{29}$, $Q_{30}$, $Q_{34}$ and $Q_{35}$ from the undesirable influence of a collector current of the transistor $Q_{26}$.

A transistor $Q_{24}$ is an N-channel opened drain MOS FET serving as an electronic switch.

With the above construction, if the switch $Q_{24}$ is turned OFF, the transistors $Q_{29}$, $Q_{30}$, $Q_{34}$ and $Q_{35}$ go ON, and the transistors $Q_{38}$, $Q_{39}$, $Q_{36}$, $Q_{37}$, $Q_{40}$ and $Q_{41}$ also go ON. Therefor, the power supply source goes ON to supply the load $R_L$. In this case, the switch $Q_{24}$ has an output impedance of several 10 M$\mu$ in the OFF state, so that the internal connection of the switch $Q_{24}$ can be ignored.

Next, when the switch $Q_{24}$ is turned ON, a starting current supplied to the constant-current circuit flows into the drain source electrodes of switch $Q_{24}$, so that the transistors $Q_{29}$, $Q_{30}$, $Q_{34}$, and $Q_{35}$ are cut off, and the transistors $Q_{38}$, $Q_{39}$, $Q_{36}$, $Q_{37}$ and $Q_{40}$ are cut off, and then the whole power supply source is placed in the OFF condition, and the output thereof to the load $R_L$ is interrupted. In this case, if the resistor $R_{21}$ is made about 3 M$\mu$, when the power supply voltage $V_{EE}$ is 3 V, the current flowing into the resistor $R_{21}$ becomes about 1 $\mu$A, so that if the transistors $Q_{25}$ and $Q_{26}$ are also made pair-like, the current flowing into the switch $Q_{24}$ is minimized to 100 nA. That is, as compared with the conventional ones, the power to be consumed in the switch can be mitigated by a large margin and the switch, i.e., FET having small capacity can be used, so that more minimization for the device can be obtained. Moreover, the current to be consumed at the time of switching off condition, as apparent from the above, is determined by a resistance value of the resistor $R_{21}$, but as an embodiment, it can be suppressed to 1 $\mu$A even with the use of an IC of 150 elements. Moreover, if FET is connencted to the resistor $R_{21}$ in series, the power to be consumed at the time of switching off condition can further be minimized. With the use of such circuit, when the power supply source is turned ON condition by turning the switch $Q_{24}$ OFF, the positive feedback operation is also performed by the transistors $Q_{27}$, $Q_{28}$, $Q_{29}$ and $Q_{30}$, so that the rising operation of the power supply source is advantageously quick.

With such construction, therefore, the power to be consumed at the time of switching the electronic switch OFF condition can be mitigated by a large margin, so that even in case of a battery having small capacity, a lifetime of the battery can sufficiently be secured, and the electronic switch itself can be miniaturized, and thus the present invention can contribute to miniaturize tape recorder or the like.

In addition, the present invention is not limited to the above embodiments but can be modified without departing from the scope of the invention.

As described above, according to the present invention, it is possible to provide a power supply device with the use of an electronic switch which can mitigate electric power to be consumed at the time of switching off condition by a large margin.

What is claimed is:

1. In a power supply device having a reference voltage generator circuit for generating an output therefrom in response to a reference voltage, the improvement comprising a constant-current circuit for generating a constant current to obtain the reference voltage, a starting circuit for supplying a starting current to the constant-current circuit and for branching a part of the starting current, and an electronic switch for shunting the starting current so as to turn the constant-current circuit OFF, said starting circuit and said constant-current circuit having active elements and passive resistive elements, said switch having only active elements and being connected only to active elements of said constant-current circuit and said starting circuit.

2. A power supply device as claimed in claim 1, wherein the electronic switch is an MOS FET.

3. A device as in claim 1, wherein said constant-current circuit includes an input having a transistor base and emitter said switch including an FET having source and drain connected directly to the base emitter.

* * * * *